US006371607B2

(12) United States Patent
Wouters et al.

(10) Patent No.: US 6,371,607 B2
(45) Date of Patent: Apr. 16, 2002

(54) INK JET PRINTER AND AN INK SUPPLY SYSTEM THEREFORE

(75) Inventors: Paul Wouters, O.L.V. Waver; André Van Geyte, Sint-Katelijne-Waver; Bart Verhoest, Niel, all of (BE)

(73) Assignee: AGFA-Gevaert, Mortsel (BE)

( * ) Notice: Subject to any disclaimer, the term of this patent is extended or adjusted under 35 U.S.C. 154(b) by 0 days.

(21) Appl. No.: 09/896,212

(22) Filed: Jun. 29, 2001

Related U.S. Application Data

(60) Provisional application No. 60/219,049, filed on Jul. 18, 2000.

(30) Foreign Application Priority Data

Jun. 29, 2000 (EP) ..... 00202261

(51) Int. Cl.[7] ..... B41J 2/18
(52) U.S. Cl. ..... 347/89
(58) Field of Search ..... 347/85, 86, 87, 347/89

(56) References Cited

U.S. PATENT DOCUMENTS 4,462,037 A * 7/1984 Bangs et al. ..... 347/85
4,677,448 A * 6/1987 Mizusawa et al. ..... 347/85
4,700,202 A * 10/1987 Kuranishi et al. ..... 347/86

FOREIGN PATENT DOCUMENTS

| | | |
|---|---|---|
| EP | 0 916 502 | 11/1998 |
| EP | 00 20 2261 | 12/2000 |
| WO | WO 97/44194 | 11/1997 |

* cited by examiner

*Primary Examiner*—Anh T. N. Vo
(74) *Attorney, Agent, or Firm*—John A. Merecki; Hoffman, Warnick & D'Alessandro LLC

(57) ABSTRACT

An ink jet printer including an ink-supply system having: a lower ink container, an upper ink container, a liquid droplet deposition apparatus with nozzles, wherein an ink circulator is provided for circulating ink from the lower container to the upper container and from the upper container through the liquid droplet deposition apparatus (a printhead) back into the lower container and wherein the upper container, having a bottom and side walls and containing ink forming an ink surface, has a first compartment with an inlet for ink wherein the inlet contains a flow guiding device for avoiding directional flow of the ink towards the ink surface and a second compartment, separated from the first one by a partition placed between the first and second compartments so that the two compartments communicate only in a lower part of the upper container.

21 Claims, 8 Drawing Sheets

INK JET PRINTER AND AN INK SUPPLY SYSTEM THEREFORE

This application claims the benefit under 35 U.S.C. Section 119(e) of U.S. Provisional Application No. 60/219,049 filed Jul. 18, 2000.

FIELD OF THE INVENTION

This invention relates to droplet deposition apparatus and especially to printheads in ink jet printers. In particular it relates to a system for providing liquid ink at proper static (hydraulic) pressure to a series of printheads in a drop-on-demand ink jet printer.

BACKGROUND OF THE INVENTION

In ink-jet liquid droplet deposition apparatus, it is important that the proper static (hydraulic) pressure, typically a small negative static (hydraulic) pressure, is achieved at each ink jet nozzle to avoid drool of the ink. In commercial ink jet printing applications, it is advantageous to provide a printing apparatus having a large printing area to permit imaging of a large image on a target surface without multiple passes of the surface past the printing head. This may be accomplished by providing a number of liquid droplet deposition apparatus (printheads) vertically stacked or "stitched" together. Vertically stacked liquid droplet deposition apparatus arrangements, however, present special problems associated with the control of static (hydraulic) pressure, and their commercial advantages have heretofore been limited by increasing costs or complexity relating to ink storage and delivery.

In, e.g., WO-A-97 44194 a solution to this problem has been disclosed. In that document an ink-supply system is disclosed for providing ink in an apparatus having a first set of nozzles at a higher elevation than a second set of nozzles, comprising: a first compartment in fluid flow communication with the first set of nozzles, said first compartment being configured to allow the egress of liquid to maintain the level of liquid therein at a desired fill height; a second compartment in fluid flow communication with the second set of nozzles, said second compartment being configured to allow the egress of liquid to maintain the level of liquid in the second compartment at a desired fill height; and a reservoir for supplying liquid to the first and second compartments. A pump circulates the ink. Although the ink supply system disclosed in WO-A-97 44194 does performs well for maintaining the desired level of static (hydraulic) pressure at each liquid droplet deposition apparatus, there is still need, as disclosed in that document, for a degassing device to evacuate the air from the ink that is circulated by a pump. The inclusion of this device makes the construction quite expensive.

The problem of air inclusion in ink supply systems of ink jet printers can be addressed as disclosed in EP-A-916 502. In this disclosure a quite complicated combination of ink tanks, suction pumps and valves are provided to degas the ink and to keep the static (hydraulic) pressure at the nozzles constant. To achieve this latter property, an ink sensor is used for sensing the height of the ink in one of the ink tanks.

It has been recognised that when, circulating ink through an ink supply system to the nozzles of the liquid droplet deposition apparatus, not only inclusion of air is possible but also the inclusion of dust particles. When such particles arrive at the nozzles, they can become attached to the nozzle and eventually block one or more nozzles in the liquid droplet deposition apparatus. This has a detrimental effect on printing quality.

Thus it is still desirable to provide an ink supply system that is simple to construct, that has a small number of moving parts and wherein the static (hydraulic) pressure at the nozzles of the liquid droplet deposition apparatus is kept constant and wherein gas and/or dust inclusion are prevented.

OBJECTS AND SUMMARY OF THE INVENTION

It is an object of the invention to provide an ink supply system for an ink jet printer that is simple to construct, that has a small number of moving parts and wherein the static (hydraulic) pressure at the nozzles of the liquid droplet deposition apparatus is kept constant and wherein gas and/or dust inclusion are prevented.

It is a further object of the invention to provide an ink supply system for a "piezo" ink jet printer wherein the ink supply is circulated and that the flow of ink proceeds with very low or no pulsations so that the ink ejection by exerting "piezo" pressure on the ink (i.e. by applying a pulse to the ink) is not perturbed by pulsations in the ink due to the circulation of the ink.

Further objects and advantages of the invention will become clear from the detailed description herein after.

The objects of the invention are realised by providing an ink jet printer including an ink-supply system comprising:

a lower ink container (100), an upper ink container (104), a liquid droplet deposition apparatus with nozzles (107) wherein an ink circulator (102) is provided for circulating ink from said lower container to said upper container and from said upper container through said liquid droplet deposition apparatus back in to said lower container characterised in that said upper container, having a bottom wall (110) and side walls (111) and containing ink (101) forming an ink surface (116), has a first compartment (I) with an inlet (114) for ink wherein said inlet contains a flow guiding device **(114, 114*a*) for avoiding directional flow of said ink towards said ink surface and a second compartment (II), separated from said first by a partition (112)** placed between said first and second compartments and having an opening so that said two compartments communicate only in the lower half of said upper container.

DETAILED DESCRIPTION OF THE INVENTION

Figure 1:
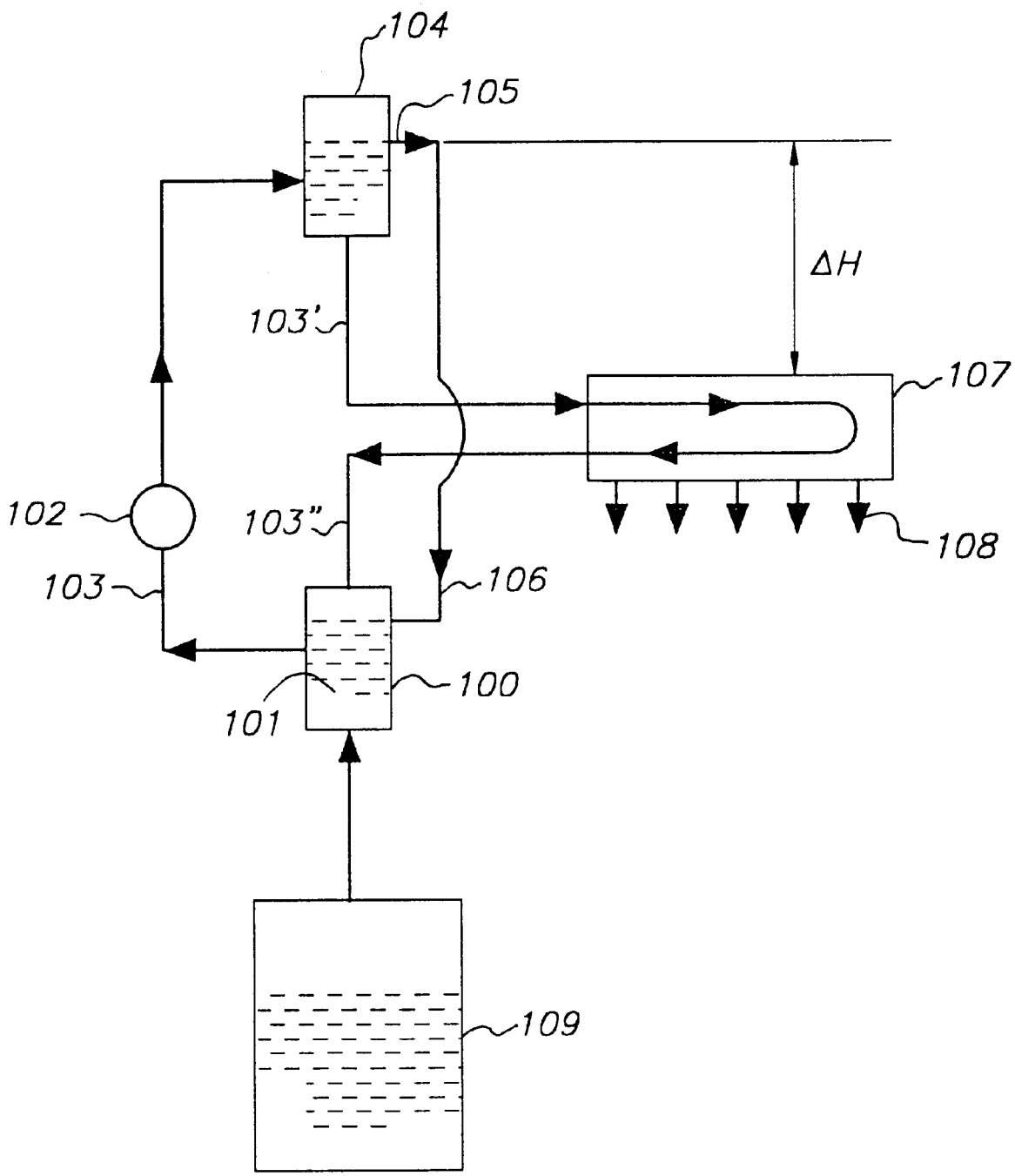
FIG. 1 shows schematically an ink jet printer and an ink supply system therefore.

FIG. 1 shows very schematically an ink jet printer and an ink supply system therefore. From a lower container (100) containing ink (101) the ink is brought to an upper container (104) through ducts (103) by an ink circulator such as a pump (102). The upper container (104) has an overflow opening (105) for maintaining the ink level in said container at a constant level, by a duct (106) the overflowing ink is returned to the lower container (100). The difference in height (ΔH) between the ink level in the upper container and the liquid droplet deposition apparatus determines the static (hydraulic) pressure in the liquid droplet deposition apparatus. By adjusting this difference in height (ΔH), drool is avoided. From the upper container (104) ink is brought through a duct (103*a*) to liquid droplet deposition apparatus (107) wherein the ink is circulated, part of the ink is image wise ejected (108) to an image receiver (not shown) and the remaining ink is brought back to said lower container through a duct (103*b*). In the supply system a container with ink (109) is provided for replenishing the ink used during image wise ejection. An ink supply system as described above can be used with any liquid droplet deposition apparatus know in the art. Such an ink supply system, wherein ink is circulated can very advantageously be used in an ink jet printer comprising one or multi-channel pulsed droplet deposition apparatus in which piezo-electric actuator means are used for droplet ejection. According to this art, an ink channel connects an ink reservoir to an ejection nozzle. Piezo electric transducers adjacent to the channel respond to a voltage impulse to generate a pressure pulse in the ink and eject ink droplet from the nozzle. Such multi-channel pulsed droplet deposition apparatus have been disclosed in, e.g., U.S. Pat. Nos. 3,946,398, 3,683,212, 3,747,120, 4,525,728, 4,549,191 and 4,584,590 and IBM Technical Disclosure Bulletin Vol. 23 No. 10 March 1981. In EP-A-278 589 multi-channel pulsed droplet deposition apparatus improved over the mentioned disclosures have been shown, also in EP-A-277 703, EP-A-278 590 and U.S. Pat. No. 5,855,713 multi-channel pulsed droplet deposition apparatus are disclosed.

Although in FIG. 1 only one liquid droplet deposition apparatus (printhead) is shown being served from an upper container, it is possible to have multiple liquid droplet deposition apparatus served by a single upper container. In this case, since the difference in height (ΔH) between the ink level in the upper container and the liquid droplet deposition apparatus determines the static (hydraulic) pressure in the liquid droplet deposition apparatus, all apparatus must be placed at the same ΔH from the level of the ink in the upper container. Thus several liquid droplet deposition apparatus can be placed on a single row a the same height relative to the level of ink in the upper container and be served by a single upper container.

In any ink jet printer having an ink circulation circuit described in FIG. 1 and any printhead known in the art, it is important that the level of the ink in the upper container (104) does not fluctuate but also that the surface of the ink stays level during operation of the printer. Even fluctuations (pulsations) caused by the pump that is used to circulate the ink have to be avoided, since even these small wave-like fluctuations of the ink surface in the upper container do change the difference in height (ΔH) between the level of the ink and the printhead and can thus change the size of the droplet and/or the speed of ejection, when strong waves are produced on the surface of the ink in the upper container, even drool at the nozzles of the printhead can occasionally occur. When using the an ink circulation circuit described in FIG. 1 then the flow of ink has to proceed with very low or no pulsations so that the ink ejection by exerting "piezo" pressure on the ink (i.e. by applying a pulse to the ink) is not perturbed by pulsations in the ink due to the circulation of the ink. To achieve an unperturbed surface of the ink in the upper container and to alleviate the pulsations of the pump used to circulate the ink as shown in FIG. 1, the construction of the upper container plays an important role. It proved possible to avoid the problems cited above, simply by adapting the mechanical construction of the upper container without needing any moving parts. Basically the construction boils down to introducing in the container a labyrinth forcing the ink to pass the labyrinth close to the bottom of the container so as to leave the air or gas entrapped in the ink the possibility to escape towards the surface of the ink in the container.

Figure 2:
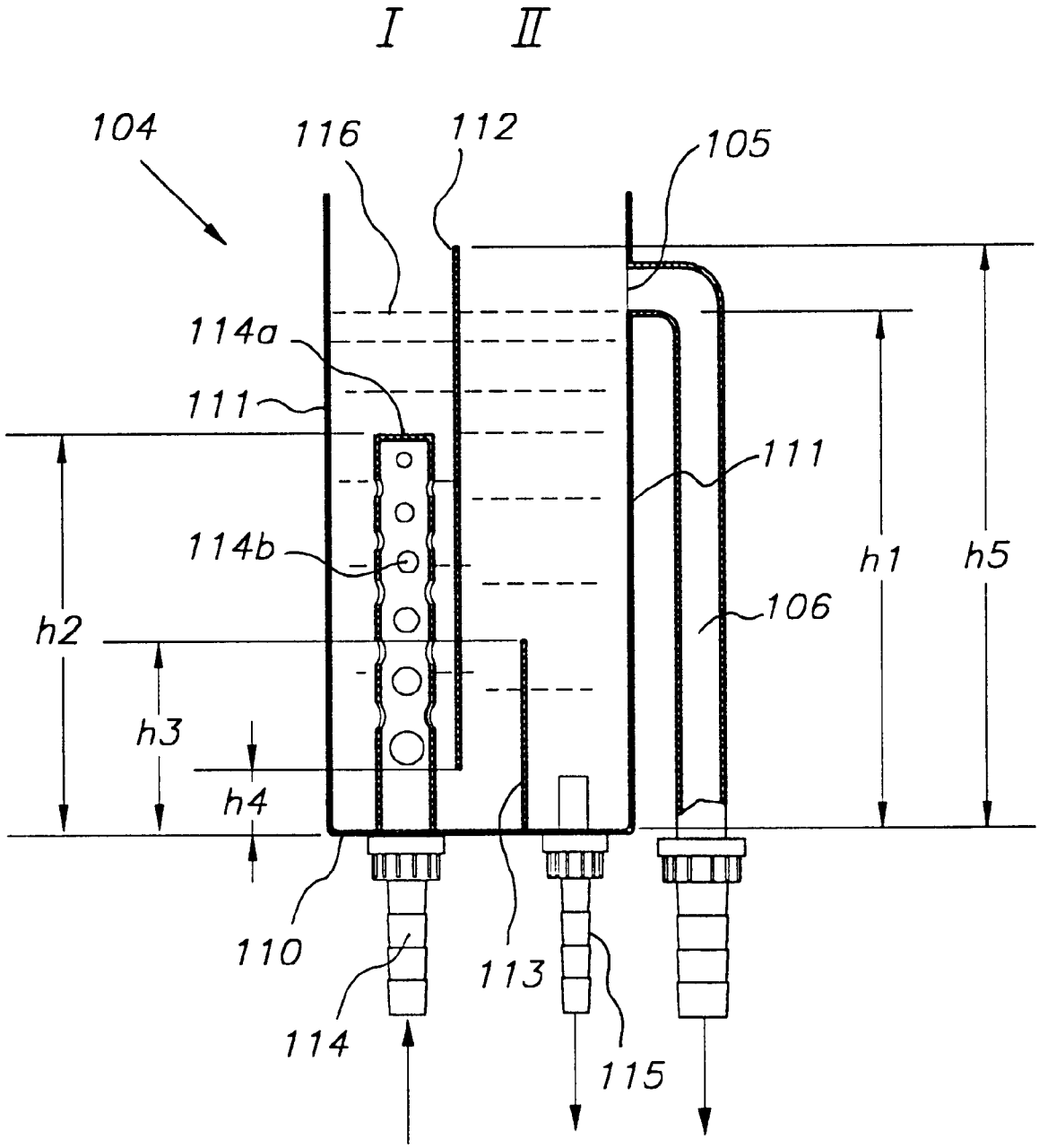
FIG. 2 shows schematically a possible construction of an upper container for use in an ink jet printer and an ink supply system according to this invention.

A possible embodiment of such an upper container is shown in FIG. 2. The upper container (104), having a bottom wall (110) and side walls (111), has an overflow opening (105) located at an height, h1, above the bottom wall (110) of the container, so that the ink in the container reaches a constant level at a height, h1, above the bottom wall (110). A duct (106) conducts the ink back to the lower container (not shown). The container (104) is divided in two compartments, an inlet compartment (I) and a print/overflow compartment (II), by a partition (112). This partition is placed so that the upper end of it extends to a height, h5, above the bottom wall and so that h5>h1. Close to the bottom wall, this partition has an opening with height, h4, so that both compartments are in communication with each other. The height, h4, is preferably equal to or smaller than 0.3×h1, more preferably equal to or smaller than 0.15×h1. In the FIG. 2 the opening with height, h4, between the partition (112) and the bottom wall is placed directly on the bottom wall (110), this is a preferred embodiment, but the opening can be made in the partition (112) at some distance away from the bottom wall. The height of the opening and the exact placement are chosen so that the ink is forced to leave compartment one in the lower part of the container, at a height lower than 0.5×h3 can serve the purposes of this invention. In the inlet compartment (I) an inlet (114) for ink is present, preferably this inlet is capped (114*a*) and has side openings (114*b*), so that the inflowing ink is forced downwards and sidewards and cannot disturb the surface (116) of the ink. This inlet extends in the inlet compartment (I) to a height, h2, chosen to be smaller than the height, h1. Preferably, h2≦0.9×h1, more preferably h2≦0.75×h1. In the implementation shown in the FIG. 2 the capping of the inlet is realised by using a pipe that is closed at one end. The person skilled in the art will however appreciate that other forms of capping are even suitable as long as the inflowing ink is forced downwards and sidewards and cannot disturb the surface (116) of the ink. In the print/overflow compartment (II) also a partition (113) is present. This partition has a height, h3, smaller than h1 and is fixed on the bottom wall (110) of the container (104). Preferably h3≦0.85×h1, more preferably h3≦0.5×h1. In the print/overflow compartment an outlet (115) is present for conducting the ink to the printhead (multi-channel pulsed droplet deposition apparatus) which is not shown in FIG. 2. This outlet is placed behind the partition (113) in the print/overflow compartment, i.e., farther away from the inlet compartment than the partition (113). The partition (112) between the two compartments and the partition (113) in the print/outlet compartment form a kind of labyrinth. In operation the ink enters the inlet compartment (I) and is forced to flow downwards, by doing so air bubbles that may be entrapped in the ink will mount to the surface (116) of the ink instead of staying with the ink that is forced down, thus by the mechanical construction of the upper container air, that may be entrapped in the ink, is evacuated from the ink. Since the inlet is capped, the force of the stream of ink is directed away from the surface of the ink and thus leaves the surface (116) undisturbed. This means that it is possible to use any type of pump for circulating the ink, because the variations in the force of the ink due to pulsations of the pump are, due to the construction of the upper container (104), of no consequence for the surface of the ink, which stays level. The consequence is that the height, h1, stays constant and that thus almost laminar flow is preserved, the size and the speed of the droplets ejected in the printhead remains constant. However in a preferred embodiment of the invention, a pump with low pulsation is used, e.g., screw pumps or centrifugal pumps. The latter type of pump is especially preferred.

Figure 3:
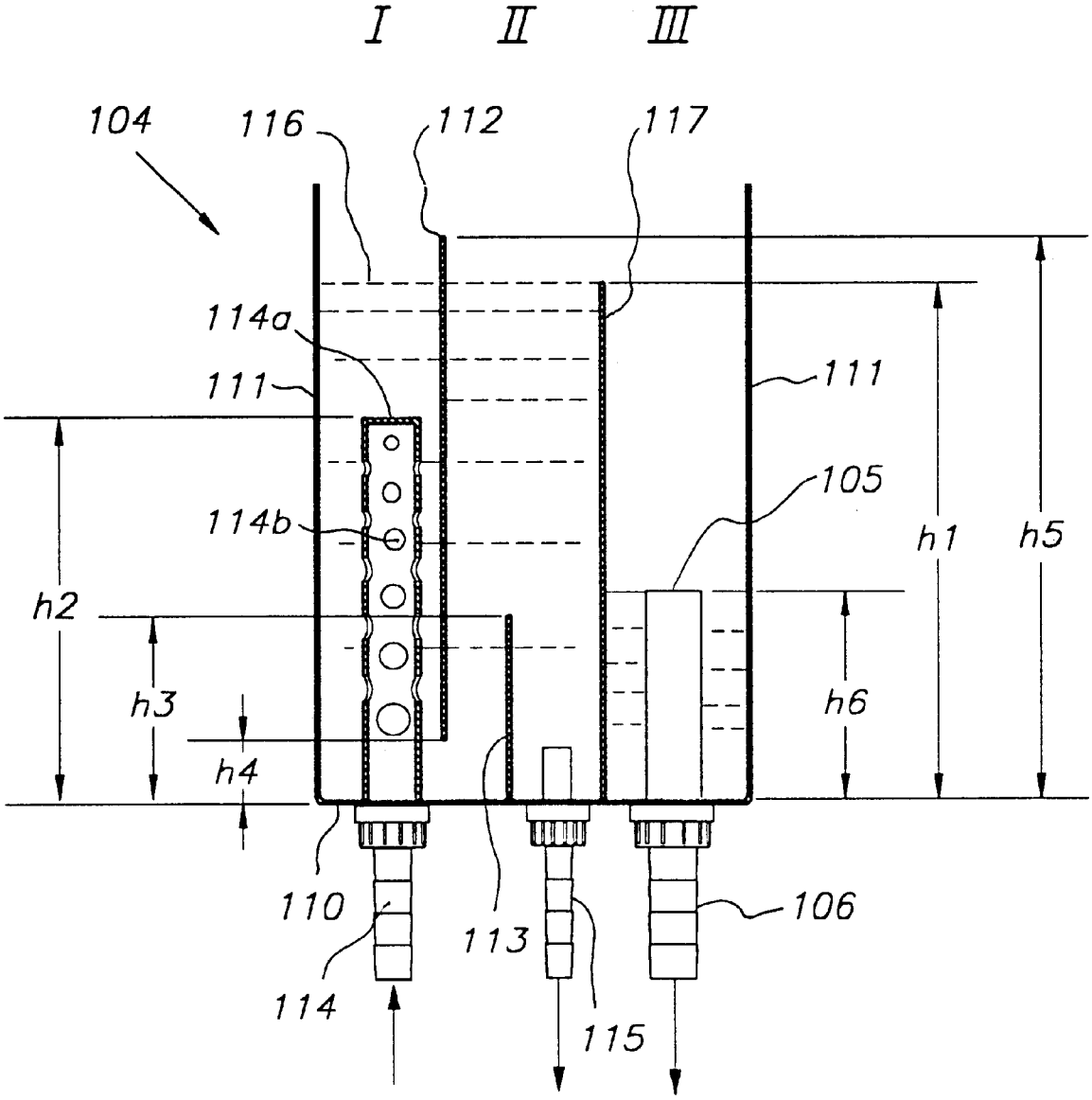
FIG. 3 shows another possible construction of an upper container for use in an ink jet printer and an ink supply system according to this invention.

Although the construction of the upper container as shown in FIG. 2 does as explained solve the problems of prior art ink supply systems, i.e., pulsation dampening, air evacuation, occasional drool avoidance with simple constructional measures, it showed that a further improvement could be realised by the embodiment shown in FIG. 3. The upper container is now divided in three compartments, an inlet compartment (I), a print compartment (II) and an outlet compartment (III). Basically the inlet compartment (I) and the print compartment (II) are construed in the same manner as explained when discussing FIG. 2 and present the same advantages. Therefore this discussion will not be repeated here. The outer wall (111) shown in FIG. 2 as farthest away from the inlet compartment has now become an inner wall (117) separating the print compartment from the outlet compartment. The height of that inner wall (117), h1, is lower than the height of the outer walls and thus ink can flow over the edge of the inner wall in the outlet compartment (III). The side of the inner wall (117) facing the outlet compartment can, when so desired, be treated so as to be easily wetted by the overflowing ink, which can make the ink flow in the outlet compartment almost as a laminar flow, thus avoiding any air inclusion during overflow. It is desired in an ink jet printer according to this invention to accurately balance the wettability of the surfaces contacting the ink, so that the occurrence of film forming at the surface of the ink, where the ink surface contacts the wall and partitions in the container, is minimised and that the laminar flow of the ink along some surfaces of the container is not impaired. It may in a printer of this invention thus be necessary to have some walls and partitions—or parts of them—treated so that the wettability by the ink is poor for avoiding excessive drying of the ink and to have some walls and partitions—or parts of them—treated so that the wettability by the ink is rather good for increasing the laminarity of the ink flow. In the outlet compartment an outlet (105) is present and has a height, h6, so that the ink has to accumulate first to a certain extent in the outlet compartment before it leaves the compartment. This again helps to avoid possible air inclusions in the ink that is re-circulated through a duct (106) back to the lower container (not shown). Thus in the second embodiment of the invention only by the mechanical construction of the upper container several advantages are realised: pulsation dampening, air evacuation, avoidance of changes in size and/or speed of the ejected ink droplets and avoidance of air intake during overflow.

Figure 4:
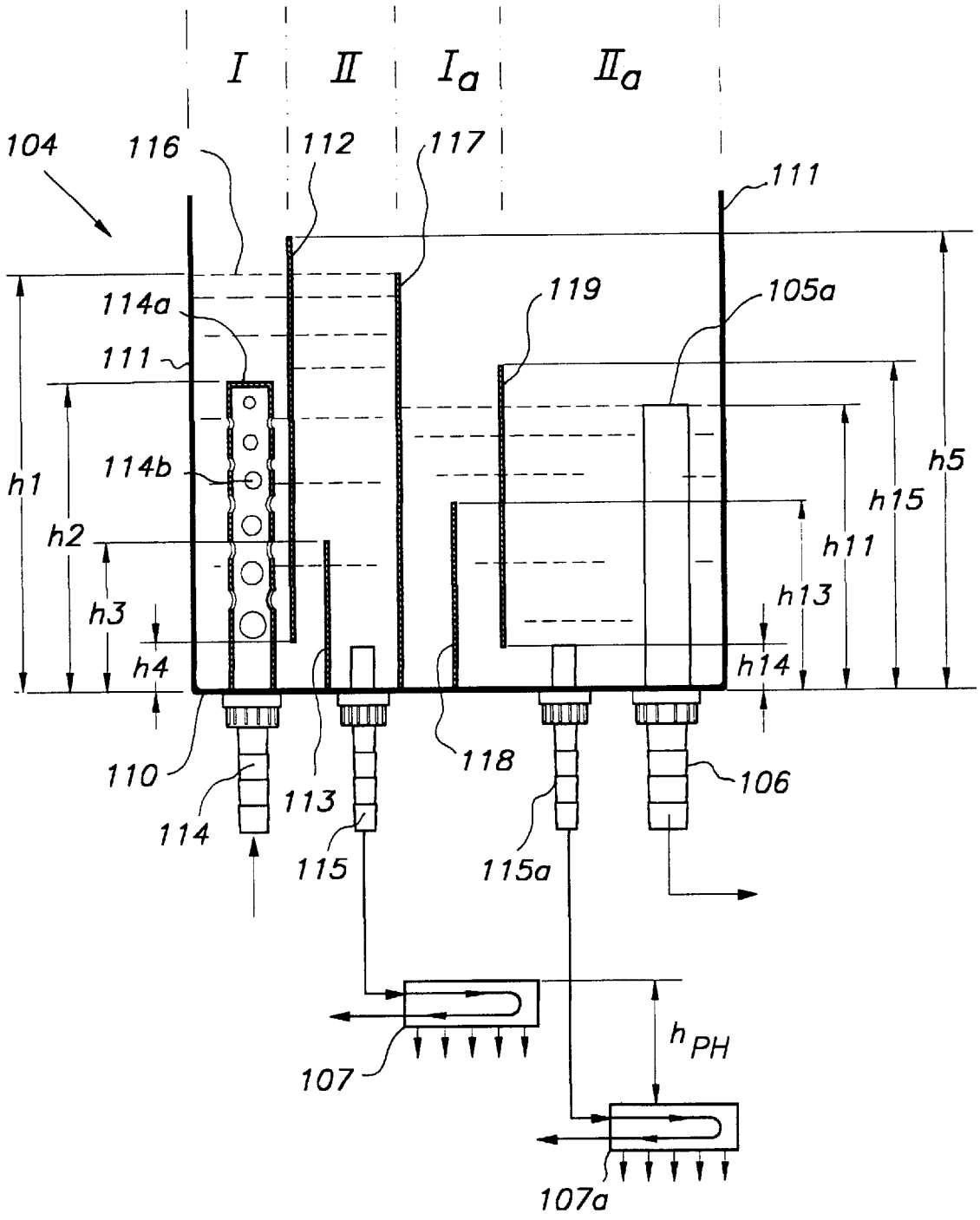
FIG. 4 shows schematically a possible construction of an upper container for use in an ink jet printer and an ink supply system according to this invention serving two rows of printheads.

When in a vertical printer it is desired to have two or more rows of liquid droplet deposition apparatus (printheads) one above the other is desired, then it is possible to use a separate upper container as described above for each of the rows, wherein the height of the ink in the container is adapted to the respective position of the rows of printheads. It is also possible to adapt the construction of a single upper container (104) to accommodate two or more rows of (printheads). In FIG. 4, this construction is schematically shown for 2 rows of printheads located at a vertical distance from each other. In the figure, for sake of clarity only one printhead of each row is shown. The upper container (104), shown in FIG. 4, comprises 4 compartments (I, II, Ia and IIa). The compartments I and II are identical to the compartments described when discussing FIG. 2, and an outlet (115) in compartment II brings the ink to a printhead of the first row (107) from where the ink is returned in the lower container (not shown). Thus compartment I and II serve printhead of the first row. The ink from compartment II flows over a partition (117) in to compartment Ia. The height (h1) of that partition (117) determines the level of ink in compartment I and II and thus, as explained earlier the static (hydraulic) pressure at the nozzles of the printhead (107). Compartment Ia and IIa are via an outlet (115*a*) connected to a printhead (107*a*) of the second row. Compartment Ia is an inlet compartment, receiving ink because ink of compartment II flows over the partition between compartment II and Ia. In the latter compartment a partition (118) is present, with a height h13. Between compartment Ia and IIa a partition (119) is present that has a height, h15, and that leaves an opening between the bottom wall (110) of the upper container, said opening having a height, h14. Compartment IIa is a print/outlet compartment that via an outlet (115*a*) provide ink to a printhead of the second row, from where the ink is returned in the lower container (not shown). This compartment also comprises an outlet (105*a*) located at a height, h11, above the bottom wall (110) of the container, via a duct (106) the ink is re-circulated to from the lower container (not shown). The rows of printhead structures are vertically displaced over a height $h_{pH}$, the difference between h1 and h11 is adjusted so that $h_{pH}$=h1–h11, so that in the upper and lower row of printheads the same static (hydraulic) pressure is present. Since basically the construction of the compartments Ia and IIa is equal to the construction of the compartments I and II, the advantages explained when discussing FIG. 2 and 3—where the upper container served only one row of printheads—are present for the two rows of printheads.

When it is desired to use more that two rows of printheads, the person skilled in the art can easily appreciate that by adding compartments, as described, in pairs to the upper container, an upper container can be constructed that can serve three or more rows of printheads while preserve all advantage that have been explained.

The advantages of the invention, realised by the construction of the upper container for ink as per this invention, are obtained when using any ink known in the art and circulating this ink at any speed customary in the art of ink jet printing. The advantage are however very prominent when in the ink jet printer uses an ink with a viscosity between 5 and 20 mPa (both limits included) and that ink is circulated at a speed between 0.1 mm/sec and 50 mm/sec (both limits included).

The advantages realised by using, in an ink jet printer including an ink-supply wherein ink is circulated from a lower container to an upper container and from that upper container through the liquid droplet deposition apparatus back in to the lower container, an upper container as per this invention, can also be realised by adapting the construction of the lower container. Basically it is possible to construct the lower container so that the ink that returns in it from the printheads (liquid droplet ejection apparatus) and from the overflow (105) of the upper container do not disturb the surface of the ink in the lower container, enter the container via an almost laminar flow. Further the construction has to be adapted so that air that may be entrapped in the ink during the circulation can easily be separated from the ink without the need for special degassing devices. Again this is achieved by introducing in the lower container a labyrinth forcing the ink to pass the labyrinth close to the bottom of the container so as to leave the air or gas entrapped in the ink the possibility to escape towards the surface of the ink in the container.

Figure 5:
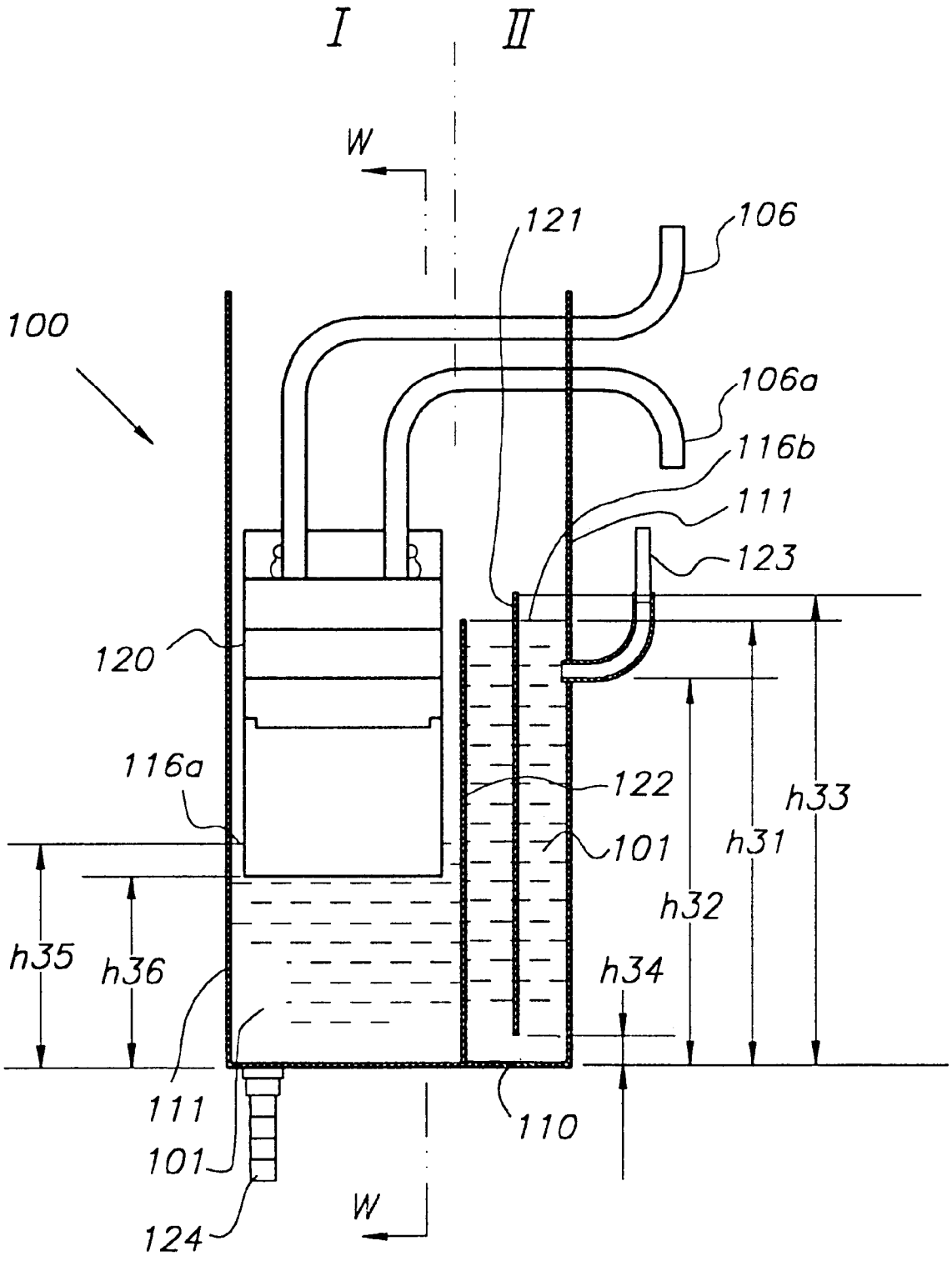
FIG. 5 shows a schematic front view of a possible construction of a lower container incorporating a "baby container" for use in an ink jet printer and an ink supply system according to this invention.

In FIG. 5 a front view of an embodiment of such a lower container is schematically shown, the front wall is shown as being transparent. The lower container (100) having a bottom wall (110) and side walls (111) is divided in two compartments, I and II. In compartment I ink (101) is present with an ink surface (116*a*). A "baby container" (120) is present in compartment I and dips in to the ink (101). The ink in compartment I has a surface at a height, h35, above the bottom wall of the lower container and the "baby container" is immersed in the ink so that the bottom wall of it is placed at a height, h36, above the bottom wall of the lower container. The height, h36, is chosen such that h36≧0.6×h35, preferably so that h36≧0.8×h35. The ink, leaving the upper container (104) via overflow (105, 105*a*), enters the "baby container" via a duct (106). Also ink entering the circulation circuit from a container (109) with ink (101), for replenishing the ink used during image wise ejection, enters in the "baby container" from a duct (106*a*). The construction of the "baby container" will be explained further on.

The first compartment (I) is separated from the second compartment (II) by a partition (122) having a height, h31. This height, h31 is chosen such that 0.25×h31≦h35≦0.95×h31, preferably so that 0.4×h31≦h35≦0.75×h31. The first compartment further comprises an outlet (124) for bringing the ink again in the circulation circuit. In the second compartments a further partition (121) is present having a height, h33 chosen such that h33>h31. At the bottom of the second compartment, the partition (121) leaves an opening with height, h34. The height, h34, is preferably equal to or smaller than 0.3×h31, more preferably equal to or smaller than 0.15×h31. In the FIG. 5 the opening with height, h34, between the partition (121) and the bottom wall is placed directly on the bottom wall (110), this is a preferred embodiment, but an opening in the partition (121) at some distance away from the bottom wall can serve the purposes of this invention. In fact when the height of the opening and the exact placement are chosen so that the ink is forced to flow from the inlet (123) to the lower part of the container, i.e. at a height lower than 0.5×h31, the purposes of the invention are also served. The ink re-circulating from the printhead (not shown) enters the second compartment via an inlet (123) situated in the side wall (111) at a height, h32. This height, h32, is chosen such that 0.25 mm≦h31−h32≦50 mm, preferably so that 0.5 mm≦h31−h32≦30 mm. The placement of the inlet (123) quite close to the surface (116*b*) of the ink in compartment II, makes is possible for air that possibly get entrapped in the returning ink can easily be evacuated via that surface (116*b*). In operation the ink, returning from the printhead, is forced down upon entering the second compartment (II) and has to pass underneath the partition (121). This also increases the separation of the liquid and the air that is possibly entrapped in it. The ink overflows then the partition (122) between the two compartments and enters the first compartment. The flow of the ink along the side of the partition (122) facing the first compartment is quasi laminar and any air not yet separated from the ink can escape from the ink on that face. When the lower container is used with in a printer with more than one row of printheads, it is possible to let the ink, returning from each row of printheads, enter the lower container in the same compartment (II) or that several compartments (II) can be added to the lower container.

Figure 6:
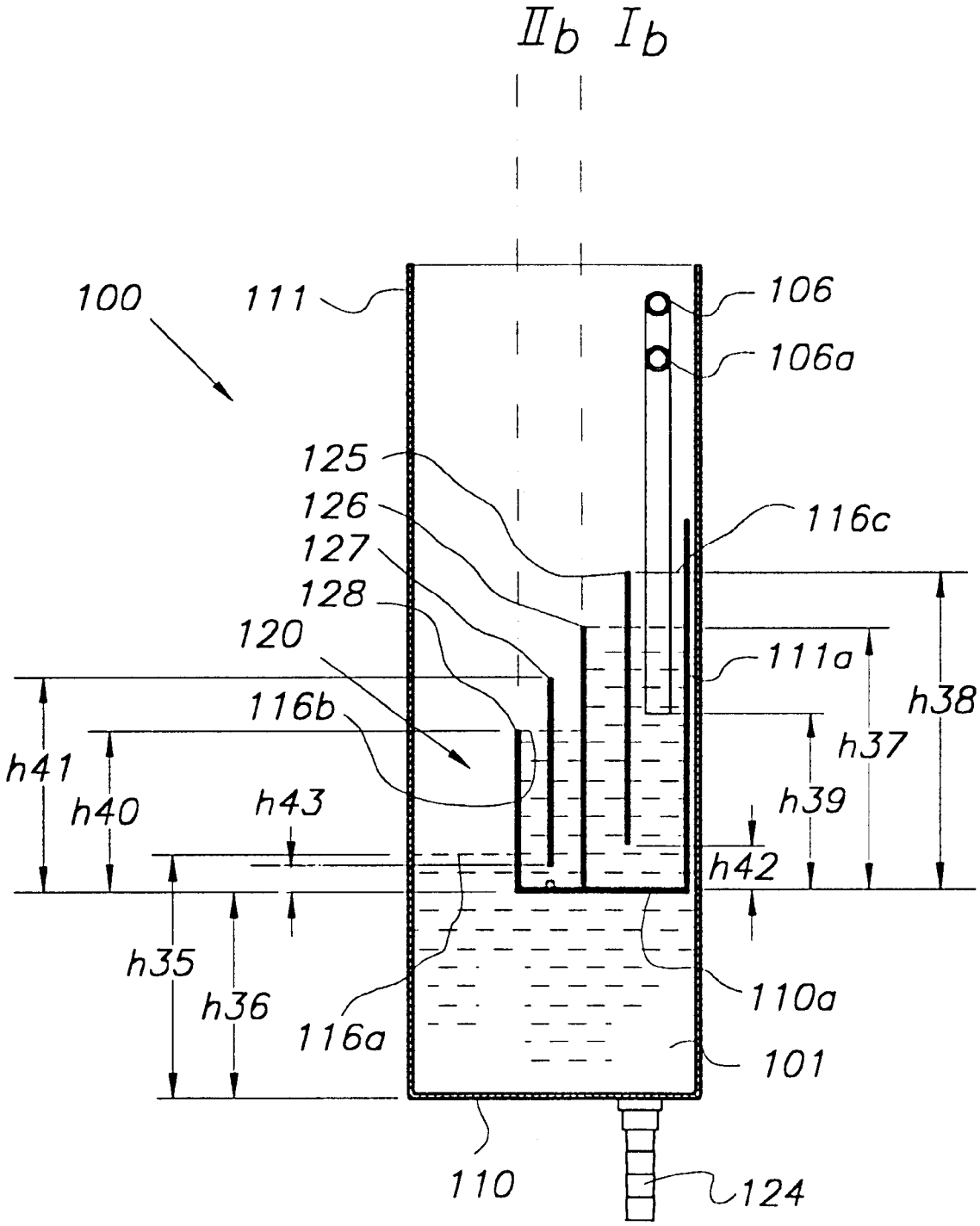
FIG. 6 shows a schematic cross sectional view along line W,W' of FIG. 5 of a possible construction of a lower container for use in an ink jet printer and an ink supply system according to this invention.

In FIG. 6, which is a cross-section of the lower container along the line W–W' in FIG. 5. It shows the lower container (100) and the "baby container" (120) in it. The "baby container" with side walls (111*a*) and a bottom wall (110*a*) dips in to the ink (101). The ink has a surface at a height, h35, above the bottom wall of the lower container and the "baby container" is immersed in the ink so that the bottom wall (110*a*) of it is placed age at a height, h36, above the bottom wall of the lower container. The height, h36, is chosen such that h36≧0.6×h35, preferably so that h36≧0.8×h35.

The ink, leaving the upper container (104) via overflow (105, 105*a*), enters the "baby container" via a duct (106). Also ink entering the circulation circuit from a container (109) with ink (101), for replenishing the ink used during image wise ejection, enters in the "baby containers " from a duct (106*a*). The baby container is also compartmentalised, an has two compartments,(Ib and IIb) separated from each other by a partition (126), with a height, h37 above the bottom wall of the "baby container". The ink, leaving the upper container (104) via overflow (105, 105*a*), enters the "baby container" via a duct (106) in the first compartment (Ib). Also ink entering the circulation circuit from a container (109) with ink (101), for replenishing the ink used during image wise ejection, enters in the "baby container" from a duct (106*a*) in the first compartment (Ib). The ducts extend under the surface (116*c*) of the ink in the baby container, so that the ink has no free fall. Both ducts (106 and 106*a*) enter the "baby container" at a height, h39 above the bottom wall of the "baby container". This height, h39, is chosen such that 0.25 mm≦h37−h39≦30 mm, preferably so that 0.5 mm≦h37−h39≦15 mm. The placement of the ducts (106 and 106*a*) quite close to the surface (116*c*) of the ink in compartment Ib, makes is possible for air that possibly get entrapped in the returning ink can easily be evacuated via that surface (116*c*). In the first compartment (Ib) of the "baby container", a partition (125) is placed, having a height, h38, measured from the bottom wall of the "baby container" said height, h38 being such that h38>h37. At the bottom of the partition (125) an opening with height, h42 is left. The height, h42, is preferably equal to or smaller than 0.3×h37, more preferably equal to or smaller than 0.15×h37. In the FIG. 6 the opening with height, h42, between the partition (125) and the bottom wall is placed directly on the bottom wall (110*a*), this is a preferred embodiment, but an opening in the partition (125) at some distance away from the bottom wall can serve the purposes of this invention. In fact when the height of the opening and the exact placement are chosen so that the ink is forced to flow from the ducts (106 and 106*a*)) to the lower part of the "baby container", i.e. at a height lower than 0.5×h37, the purposes of the invention are also served. From the first compartment (Ib) the ink over flows partition (126) between the two compartments in to compartment IIb, this compartment of the baby container is separated from compartment I of the lower container by a partition (128), having a height h40, measured from the bottom wall of the "baby container". Also in this compartment of the "baby container", a partition (127) is placed, having a height, h41, measured from the bottom wall of the "baby container" said height h41 being such that h41>h40. At the bottom of the partition (125) an opening with height, h43 is left. The height, h43, is preferably equal to or smaller than 0.3×h40, more preferably equal to or smaller than 0.15×h40. In the FIG. 6 the opening with height, h43, between the partition (127) and the bottom wall is placed directly on the bottom wall (110*a*), this is a preferred embodiment, but an opening in the partition (127) at some distance away from the bottom wall can serve the purposes of this invention. In fact when the height of the opening and the exact placement are chosen so that the ink is forced to flow from the ducts (106 and 106*a*)) to the lower part of the "baby container", i.e. at a height lower than 0.5×h40, the purposes of the invention are also served. The ink overflows the partition (128) in to the ink (101) in compartment I of the lower container.

It is clear that it is possible to implement a "baby container" with more than two compartments or with only one compartment as long as also in the "baby container" a kind of labyrinth is present forcing the ink to flow along the bottom of the "baby container" and leaving any air, that was possible entrapped in the ink, time and room to escape to the surface of the ink in the "baby container".

The placement of inlet (123) in the lower container (100) close to the surface (116*b*) of the ink contained in compartment II and the placement of the ducts (106 and 106*a*) in the "baby container" (120) close to the surface (116*c*) of the ink contained in compartment Ib of the "baby container" has not only the advantage of allowing easy air evacuation during operation of the printer, but has the great advantage that when starting the printer and thus starting the circulation of ink in empty ducts, the air is easily evacuated from the ducts and other parts, because the air is pushed away by the ink and can readily escape in the lower container.

Figure 7:
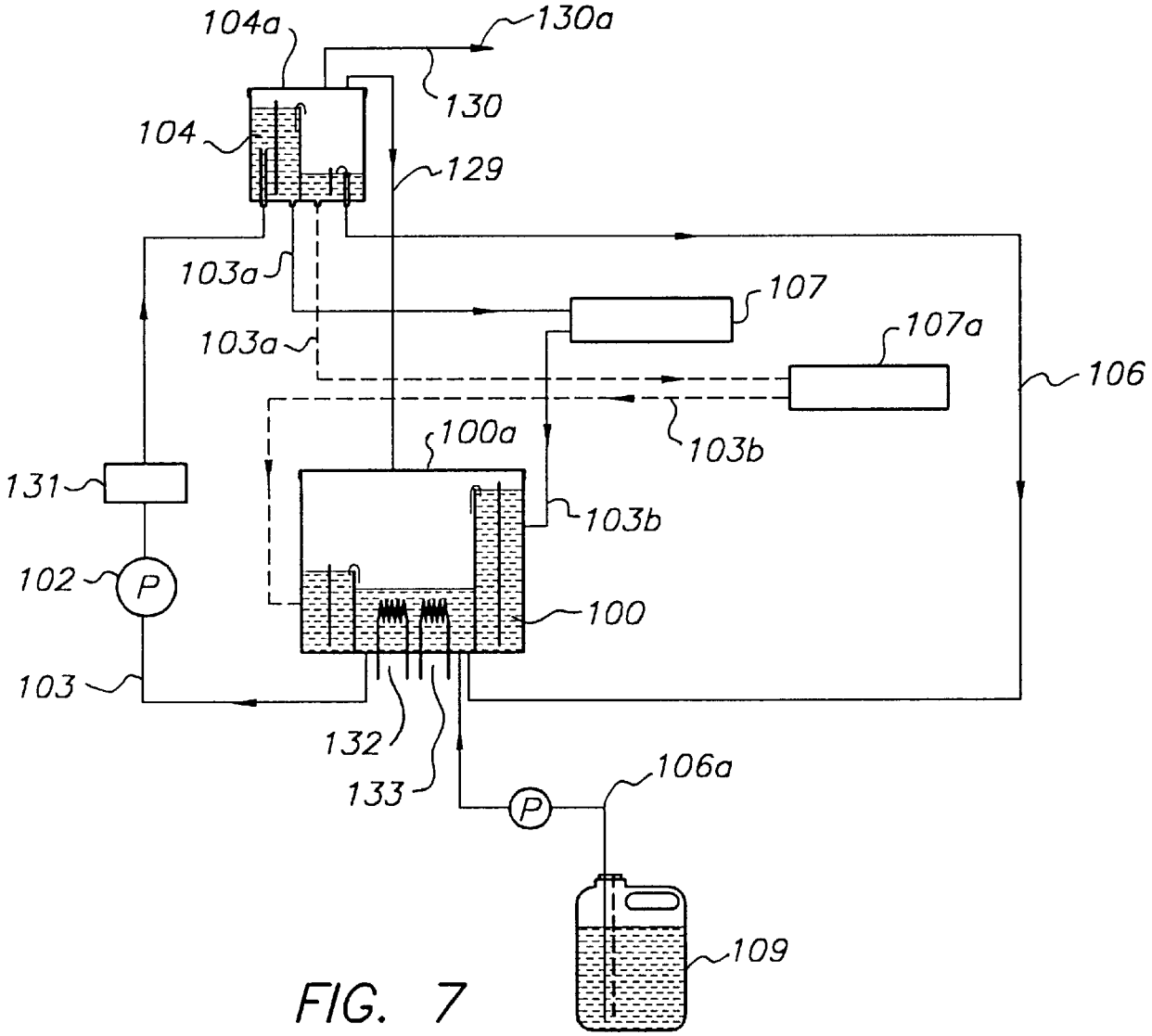
FIG. 7 shows schematically a printer incorporating an upper and lower container of this invention.

Although the advantages of the invention: pulsation dampening, air evacuation, avoidance of changes in size and/or speed of the ejected ink droplets and avoidance of air intake during overflow, can be realised by using either an upper container or a lower container according to this invention, in a most preferred embodiment of an ink jet printer wherein ink is circulated both an upper container and a lower container according to this invention are shown. In FIG. 7 a schematic view of such a printer, with two rows of printheads is shown. Basically it comprises the elements as discussed in FIG. 1. The upper container and the lower container both being containers according to this invention. While both the upper and lower container may be open containers, it is preferred that both containers are capped by a lid (104*a*and 100*a*). These lids are most beneficially air tight so that no external air can enter the containers. This has the advantage that the air above the ink, in both containers, is saturated by the solvent of the ink and that evaporation of the solvent out of the ink is minimised and even prevented. Both containers are connected by a duct (129) in the respective lids so that the air in the upper container and the air in the lower container are in communication. By doing so the air/ink volume in both containers is kept almost constant and when an ink level changes in one of the containers, air from the other container is sucked to the first container or is pushed out of the is first container. E.g., when the ink level raises in the lower container, air is pushed from the lower container to the upper one through the duct (129).

Ink jet printer shown in FIG. 7, further comprises a inlet (130), equipped with a cock (130*a*) for compressed air. By bringing compressed air in the upper container, through the duct (130) it is possible to purge the printheads (107, 107*a*). It is advantageous that, when purging with compressed air is envisaged, the duct (129) between the upper and lower container is present for pressure equalisation. When this duct is present the equilibrium in the printer is not disturbed when purging with compressed air, because the pressure in the lower and upper container are, due to the presence of the duct (129), is equalised.

As seen from FIG. 7, it is possible to add conditioning means, a heater (132) and a cooler (133) for the ink, to the lower container. The placement of the conditioning means in the lower container has advantages over the placement of it at other places of the circulation circuit. In the lower container all ink comes together: overflow from the upper container, ink returning from the printheads and ink form the supply vessel (109) for replenishment, thus all the ink is conditioned at once. The amount of ink in the lower container is rather large, so that there is a buffer capacity and the conditioning means have not to cope with peaks of very cold ink or peaks of very hot ink.

In the circulation circuit a filter is placed for cleaning the ink and for avoiding that dust and other particles would reach the printhead where dust can block some nozzles and thus deteriorate the print quality. Filtration of the ink is known from, e.g., WO-A-00 21755. It was found that, when using a filter it is best to have an oversized filter, which makes it possible to use a centrifugal pump for circulating the ink. It has been explained in this document that the use of a pump with low pulsations is preferred for circulating the ink. When using an oversized filter, the pressure drop in the filter is low and thus can a pump delivering low pressure on the ink can be used. This has then further advantages with respect to the thermal and mechanical stress exerted on the ink. An oversized filter, for use in this invention is a filter that, when using ink with a viscosity between 5 to 20 mPa and a circulation speed of 3 to 5 l/min has a filter surface between 0.25 and 2 $m^2$, preferably between 0.5 and 1 $m^2$.

Figure 8A:
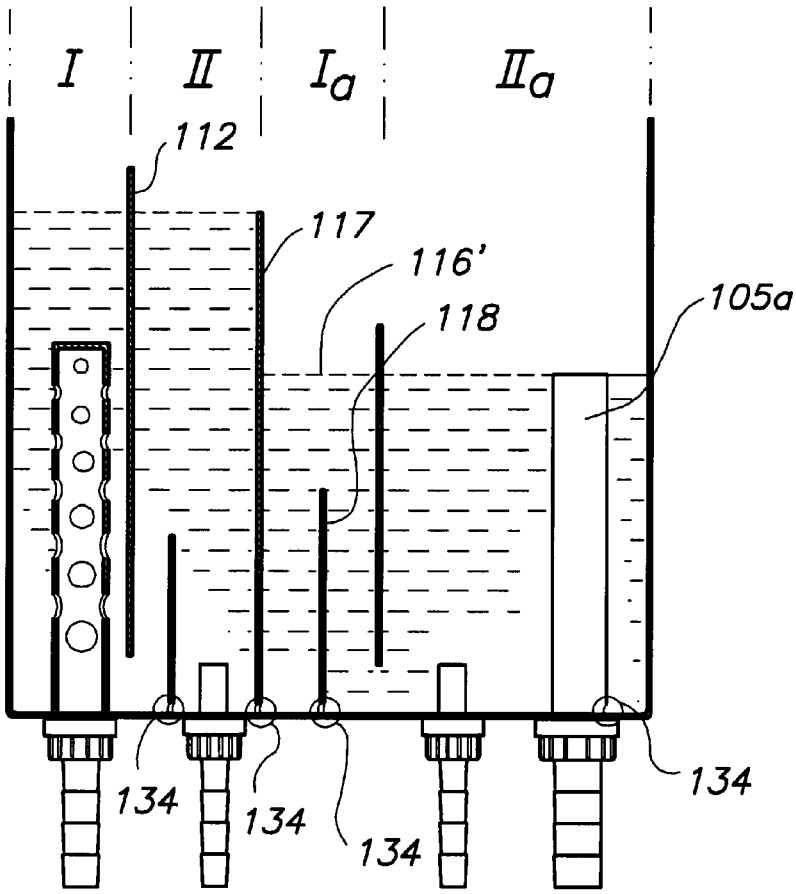
FIGS. 8A, 8B, and 8C show schematically the position of "purging" holes in partitions and overflow pipes that reach to said bottom wall of the upper and lower container and in the "baby container".
Figure 8B:
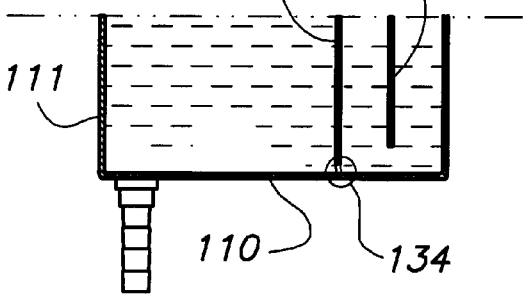
Figure 8C:
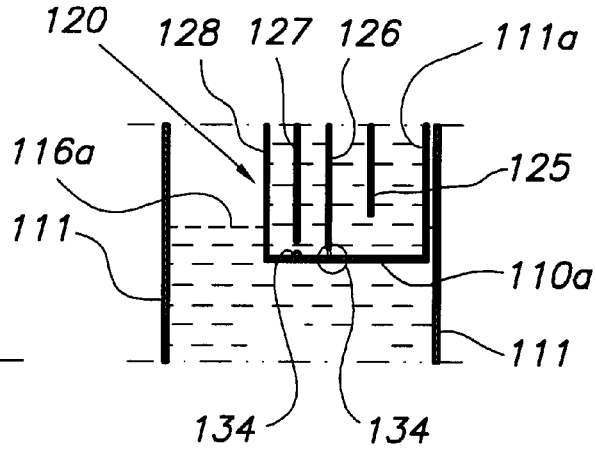

For easy cleaning of the ink circuit, it is preferred that the upper container, lower container and "baby container" can be emptied without special difficulties. This is achieved by having in the upper container small holes (134) in the partitions that reach to the bottom wall of that container, (these are partitions 113, 117,118 in the upper container, see FIGS. 3 and 4) and in the output tube (106) also at the bottom of the upper container. In the lower container there is provided a small hole in the partition (120) separating compartment II from compartment I, near the bottom of the lower container. In the "baby container" there are provided holes in the partition separating compartment Ib from compartment IIb and in the bottom wall of the "baby container" in compartment IIb. In FIGS. 8A, 8B, and 8C, the placement of the holes is shown: FIG. 8A in the upper container showing an enlargement along the bottom of the container as shown in FIG. 4, FIG. 8B in the lower container showing an enlargement along the bottom of the container as shown in FIG. 5 and FIG. 8C in the baby container, showing an enlargement along the bottom of the "baby container" as shown in FIG. 6. In the FIGS. 8A, 8B, and 8C, only the pertinent parts are numbered and explained, for the other elements and the numbering of it reference is made to the FIGS. 4, 5 and 6 respectively. The holes (134) have to be dimensioned that so as not to disturb the circulation of the ink in the ink supply system because of too much ink leaking away and so as not to get (too) easily clogged. It was found that with inks with a viscosity between 5 and 20 mPa, both limits included, the holes (134) could have an area between 5 and 15 $mm^2$, both limits included.

PARTS LIST

100 Lower container
101 Ink
102 Pump
103*a*, 103*b*, 106, 106*a* Ducts
104 Upper container
105, 105*a*Outlets for overflowing ink
107 Printhead (droplet ejection apparatus)
108 Ejected ink
109 Ink reservoir
110 Bottom wall of a container
111 Side wall of a container
112, 113, 117, 118, 119, 121, 122, 125, 126, 127, 128 Partitions
114 Inlet
114*a* Cap on inlet
114*b* Side holes in inlet
115, 115*a*Outlets to printhead
116, 116*a*, 116*b*, 116*c* surface of the ink
120 "baby container" in lower container
129 Air duct
130 Duct for compressed air
131 Filter
132 Heater
133 Cooler
134 Holes

What is claimed is:

1. An ink jet printer including an ink-supply system comprising: a lower ink container, an upper ink container, a printhead with nozzles, wherein an ink circulator is provided for circulating ink from said lower container to said upper container and from said upper container through said printhead back to said lower container, wherein said upper container, having a bottom wall and side walls and containing ink forming an ink surface at a height h1 above said bottom wall, has at least two compartments, a first one with an inlet for ink wherein said inlet contains a flow guiding device for avoiding directional flow of said ink towards said ink surface and a second one, separated from said first one by a partition extending from said bottom wall to a height h5 above said bottom wall wherein h5>h1, and having an opening, with height h4, so that said two compartments communicate only in the lower half of said upper container.

2. An ink jet printer according to claim 1, wherein said flow guiding device for avoiding directional flow of said ink towards said ink surface comprises a cap on said inlet and side openings in said inlet.

3. An ink jet printer according to claim 1, wherein said inlet has a height h2, chosen so that h2≦0.9×h1.

4. An ink jet printer according to claim 1, wherein said second compartment comprises, fixed on said bottom wall, a further partition with a height h3, chosen so that h2≦0.85×h1.

5. An ink jet printer according to claim 1, wherein said opening with height h4, in said partition placed between said first and second compartments, is located against said bottom wall and said height h4 is chosen so that h4≦0.30×h1.

6. An ink jet printer according to claim 1, wherein both said upper and said lower containers comprise an air tight lid and are connected to each other by an air duct for pressure equalisation.

7. An ink jet printer according to claim 1 wherein said ink circulator is a centrifugal pump giving said ink a circulation speed between b 3to 5 l/min both limits included and during circulation said ink is passed over a filter having a filter surface between 0.25 and 2 $m^2$.

8. An ink jet printer according to claim 1, wherein said ink jet printer is a drop on demand printer and said drops are ejected from said printhead by means of "piezo" elements.

9. An ink jet printer according to claim 1, wherein at least a portion of said walls and partitions of said upper container and said lower container have an anti-wetting coating.

10. An ink jet printer according to claim 1 wherein in said upper container and in said lower container holes are present in partitions and overflow pipes that reach to said bottom wall of said containers, said holes having an area between 5 and 15 $mm^2$ both limits included.

11. An ink jet printer including an ink-supply system comprising: a lower ink container, an upper ink container, a printhead with nozzles, where in an ink circulator is provided for circulating ink from said lower container to said upper container and from said upper container through said printhead back to said lower container, wherein said lower container has a bottom wall and side walls and includes at least two compartments, one of said compartments containing a "baby container".

12. An ink jet printer according to claim 11, wherein ink overflowing from said upper container and replenishment ink are brought through ducts in said "baby container" contained in said lower container.

13. An ink jet printer according to claim 11, wherein ink returning from said printhead enters said lower container in one of said compartments not containing said "baby container" through an inlet.

14. An ink jet printer according to claim 11, wherein one of said compartments not containing said "baby container" contains ink forming a surface at a height h31 above said bottom wall and wherein said inlet for ink returning from said printhead is placed in one of said side walls at a height h32 above said bottom wall, said height h32 being chosen such that that 0.25 mm≦h31−h32≦30 mm.

15. An ink jet printer according to claim 11, wherein said lower container further contains an ink conditioner.

16. An ink jet printer according to claim 11, including an upper container according to claim 1.

17. An ink jet printer according to claim 6 wherein, in said upper container, said lower container and said "baby container" holes are present in partitions and overflow pipes that reach to said bottom wall of said containers, said holes having an area between 5 and 15 $mm^2$, both limits included.

18. An ink jet printer according to claim 6, wherein both said upper and said lower containers comprise an air tight lid and are connected to each other by an air duct for pressure equalisation.

19. An ink jet printer according to claim 6 wherein said ink circulator is a centrifugal pump giving said ink a circulation speed between 3 to 5 l/min both limits included and during circulation said ink is passed over a filter having a filter surface between 0.25 and 2 $m^2$.

20. An ink jet printer according to claim 6, wherein said ink jet printer is a drop on demand printer and said drops are ejected from said printhead by means of "piezo" elements.

21. An ink jet printer according to claim 6, wherein at least a portion of said walls and partitions of said upper container and said lower container have an anti-wetting coating.

* * * * *